US008026870B2

(12) United States Patent
Lee

(10) Patent No.: US 8,026,870 B2
(45) Date of Patent: Sep. 27, 2011

(54) PLASMA DISPLAY APPARATUS WITH TEMPERATURE COMPENSATION AND METHOD OF DRIVING THEREOF

(75) Inventor: Soongkyu Lee, Gumi (KR)

(73) Assignee: LG Electronics Inc., Seoul (KR)

( * ) Notice: Subject to any disclaimer, the term of this patent is extended or adjusted under 35 U.S.C. 154(b) by 1019 days.

(21) Appl. No.: 11/871,488

(22) Filed: Oct. 12, 2007

(65) Prior Publication Data

US 2008/0088536 A1 Apr. 17, 2008

(30) Foreign Application Priority Data

Oct. 12, 2006 (KR) ..... 10-2006-0099288
Oct. 11, 2007 (KR) ..... 10-2007-0102577

(51) Int. Cl.
*G09G 3/28* (2006.01)

(52) U.S. Cl. ..... 345/63; 345/60

(58) Field of Classification Search ..... 345/60, 345/63

See application file for complete search history.

(56) References Cited

U.S. PATENT DOCUMENTS

| | | | | |
|---|---|---|---|---|
| 6,466,186 | B1 * | 10/2002 | Shimizu et al. | 345/60 |
| 7,102,596 | B2 | 9/2006 | Kang et al. | 345/60 |
| 2004/0021646 | A1 * | 2/2004 | Kyouzuka et al. | 345/173 |
| 2004/0119665 | A1 * | 6/2004 | Kang et al. | 345/63 |
| 2005/0259044 | A1 | 11/2005 | Choi et al. | 345/63 |
| 2006/0066518 | A1 * | 3/2006 | Mizobata | 345/63 |
| 2006/0109210 | A1 * | 5/2006 | Sakata | 345/67 |
| 2006/0158387 | A1 * | 7/2006 | Kim | 345/60 |
| 2006/0279486 | A1 * | 12/2006 | Kim et al. | 345/67 |
| 2007/0103395 | A1 * | 5/2007 | Onizuka et al. | 345/63 |

FOREIGN PATENT DOCUMENTS

| | | | |
|---|---|---|---|
| EP | 1 659 559 | A2 | 5/2006 |
| JP | 09-006283 | | 1/1997 |
| JP | 2001-282181 | | 10/2001 |
| JP | 2006-146035 | | 6/2006 |
| JP | 2007-072265 | | 3/2007 |
| JP | 2007-427840 | | 5/2007 |
| KR | 10-2001-0093628 | A | 10/2001 |
| KR | 10-2004-0023932 | A | 3/2004 |
| KR | 10-2004-0027058 | A | 4/2004 |

OTHER PUBLICATIONS

European Search Report dated Mar. 3, 2010 for Application No. 07 833 322.5.
International Search Report dated Jan. 21, 2008.

* cited by examiner

*Primary Examiner* — Richard Hjerpe
*Assistant Examiner* — Andrew Schnirel
(74) *Attorney, Agent, or Firm* — Ked & Associates LLP

(57) ABSTRACT

A plasma display apparatus comprises a plasma display panel, a temperature detector and driver. The plasma display panel comprises a plurality of first electrodes and a plurality of second electrodes formed in parallel to each other. The temperature detector for detecting a temperature of the plasma display panel to output a temperature information signal. The driver which receives the temperature information signal from the temperature detector, and if the temperature of the plasma display panel is lower than a reference temperature, clamps a first sustain signal, which is supplied to at least one of the first electrodes and second electrodes, at a first clamping time, and if the temperature of the plasma display panel is higher than the reference temperature, clamps a second sustain signal, which is supplied to at least one of the first electrodes and the second electrodes, at a second clamping time different from the first clamping time.

16 Claims, 14 Drawing Sheets

PLASMA DISPLAY APPARATUS WITH TEMPERATURE COMPENSATION AND METHOD OF DRIVING THEREOF

This nonprovisional application claims priority under 35 U.S.C. §119(a) on Patent Application No. 10-2006-0099288 and 10-2007-0102577 filed in Republic of Korea on Oct. 12, 2006, and Oct. 11, 2007 the entire contents of which are hereby incorporated by reference.

BACKGROUND

1. Field

This document relates to a plasma display apparatus and a method of driving thereof.

2. Related Art

Plasma display apparatus comprises a plasma display panel having electrodes and a driver for applying a driving signal to the electrodes of the plasma display panel.

Typically, in the plasma display panel, a phosphor layer is formed in discharge cells defined by barrier ribs, and a plurality of electrodes is formed.

The driver applies a driving signal to the discharge cells via the electrodes.

Then, a discharge occurs in the discharge cells by an applied driving signal. When a discharge occurs in the discharge cells by a driving signal, a discharge gas filled in the discharge cells generates light, such as ultraviolet rays, and this light, such as ultraviolet rays, excite the phosphor formed in the discharge cells to emit visible light. By this visible light, images are displayed on the screen of the plasma display panel.

SUMMARY

In one aspect, a plasma display apparatus comprises a plasma display panel comprising a plurality of first electrodes and a plurality of second electrodes formed in parallel to each other, a temperature detector for detecting a temperature of the plasma display panel to output a temperature information signal and a driver which receives the temperature information signal from the temperature detector, and if the temperature of the plasma display panel is lower than a reference temperature, clamps a first sustain signal, which is supplied to at least one of the first electrodes and second electrodes, at a first clamping time, and if the temperature of the plasma display panel is higher than the reference temperature, clamps a second sustain signal, which is supplied to at least one of the first electrodes and the second electrodes, at a second clamping time different from the first clamping time.

In another aspect, a method for driving a plasma display apparatus comprising first electrodes and second electrodes formed in parallel to each other, comprises if the temperature of the plasma display panel is lower than a reference temperature, clamping a first sustain signal, which is supplied to at least one of the first electrodes and second electrodes, at a first clamping time, and if the temperature of the plasma display panel is higher than the reference temperature, clamping a second sustain signal, which is suppled to at least one of the first electrodes and the second electrodes, at a second clamping time different from the first clamping time.

In still another aspect, a method for driving a plasma display apparatus comprising first electrodes and second electrodes formed in parallel to each other, comprises if the temperature of the plasma display panel is lower than a reference temperature, supplying a first sustain signal having a first voltage rising period to at least one of the first electrodes and second electrodes, and if the temperature of the plasma display panel is higher than the reference temperature, supplying a second sustain signal having a second voltage rising period longer than the first voltage rising period to at least one of the first electrodes and the second electrodes.

BRIEF DESCRIPTION OF THE DRAWINGS

The implementation of this document will be described in detail with reference to the following drawings in which like numerals refer to like elements.

DETAILED DESCRIPTION OF EMBODIMENTS

Embodiments will be described in a more detailed manner with reference to the drawings.

Figure 1:
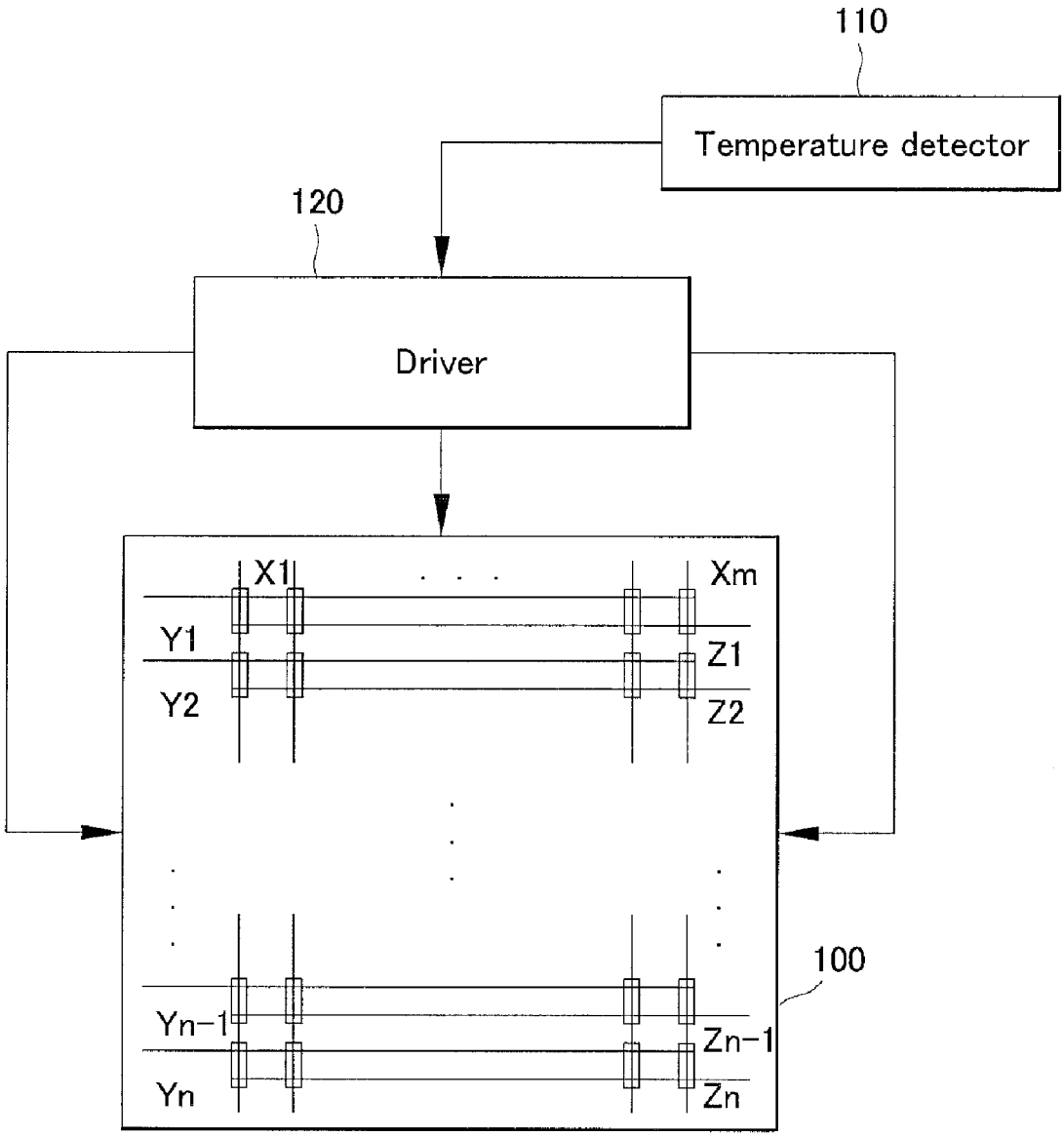
FIG. 1 is a view showing a plasma display apparatus according to one embodiment of the present invention.

As shown in FIG. 1, the plasma display apparatus according to one embodiment of the present invention comprises a plasma display panel 100, a temperature detector 110, and a driver 120.

The plasma display panel 100 comprises a plurality of first electrodes Y1-Yn and a plurality of second electrodes Z1-Zn formed in parallel to each other and a plurality of third electrodes X1-Xm intersecting the first electrodes Y1-Yn and the second electrodes Z1-Zn.

The temperature detector 110 detects a temperature of the plasma display panel 100 to output a temperature information signal.

The driver 120 receives the temperature information signal from the temperature detector 110, and if the temperature of the plasma display panel 100 is lower than a reference temperature, supplies a first sustain signal gradually rising to a first voltage or gradually rising and then falling to at least one of the first electrodes and second electrodes. Otherwise, if the temperature of the plasma display panel 100 is higher than the reference temperature, the driver 120 supplies a second sustain signal gradually rising to a second voltage or gradually rising and then falling to at least one of the first electrodes Y1-Yn and the second electrodes Z1-Zm. The first voltage formed at a first clamping time is lower than the second voltage formed at a second clamping time.

A period for supplying the first sustain signal or the second sustain signal comprises a voltage rising period and a voltage sustaining period. The voltage rising period of the first sustain signal is a time taken to rise from a reference voltage to a first sustain voltage. The voltage rising period of the second sustain period is a time taken to rise from the reference voltage to a second sustain voltage. The reference voltage may be a ground level voltage.

Figure 2:
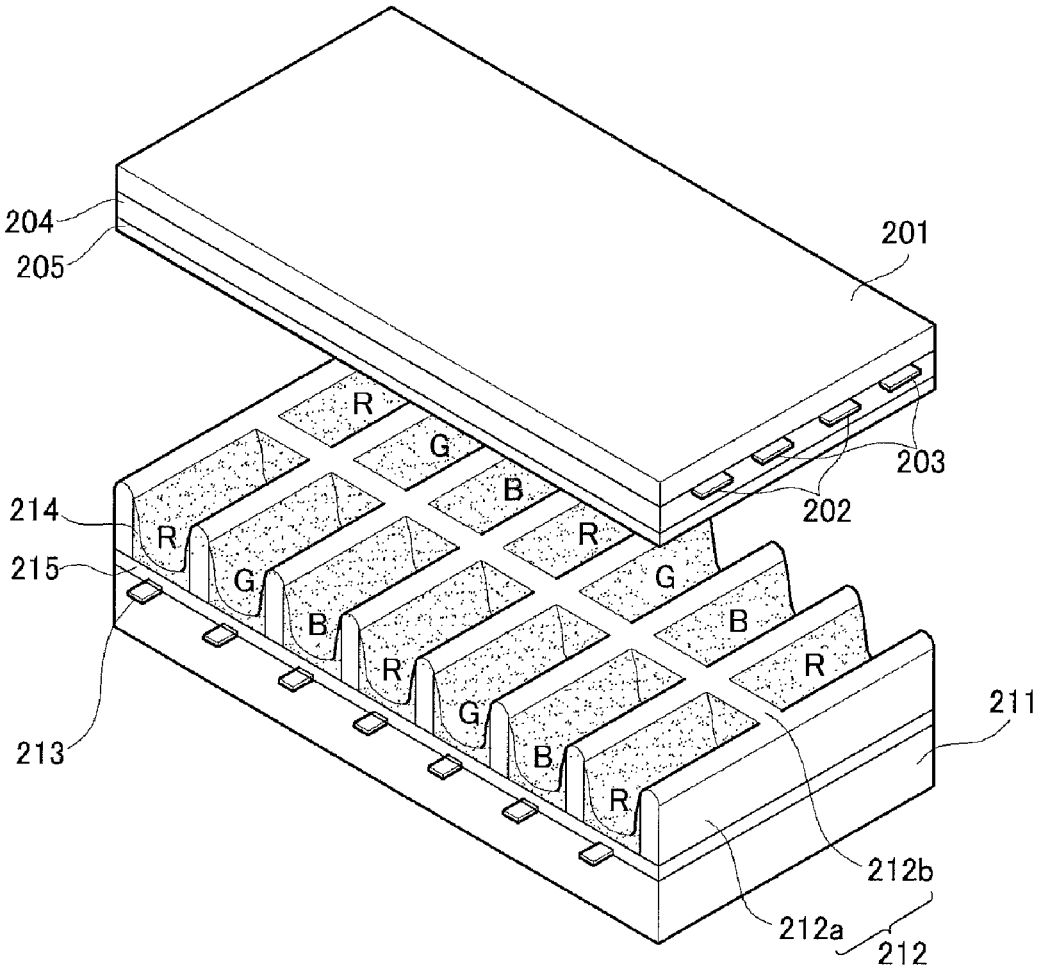
FIG. 2 is a view showing a plasma display panel of FIG. 1.

As shown in FIG. 2, the plasma display panel of FIG. 1 comprises a front substrate 201 on which a first electrodes 202 and a second electrode 203 are formed in parallel to each other and a rear substrate 211 on which a third electrode 213 is formed to intersect the first electrode 202 and the second electrode 203.

The upper dielectric layer 204 for covering the first electrode 202 (Y) and the second electrode 203 (Z) is formed on an upper portion of the front substrate 201. The upper dielectric layer 204 limits discharge currents of the first electrode 202 and the second electrode 203, and provides insulation between the first electrode 202 and the second electrode 203.

A protective layer 205 is formed on an upper surface of the upper dielectric layer 204 to facilitate discharge conditions. The protective layer 205 is formed by depositing a material such as magnesium oxide (MgO) on the upper surface of the upper dielectric layer 204.

A lower dielectric layer 215 for covering the third electrode 213 is formed on an upper portion of the rear substrate 211 on which the third electrode 213 (X) is formed. The lower dielectric layer 215 provides insulation of the third electrode 213 (X).

Barrier ribs 212 are formed on an upper portion of the lower dielectric layer 215 to defined discharge cells. The discharge cells defined by the barrier ribs 212 may comprise a red (R) discharge cell, a green (G) discharge cell, and a blue (B) discharge cell.

In addition to the red (R), green (G), and blue (B) discharge cells, a white (W) discharge cell or a yellow (Y) discharge cell may be further formed.

The pitches of the red (R), green (G), and blue (B) discharge cells may be substantially equal to one another. Further, the pitch of at least one of the red (R), green (G), or blue (B) discharge cells may be different from the widths of the other discharge cells in order to adjust a color temperature.

The plasma display apparatus according one embodiment of the present invention may have various forms of barrier rib structures as well as a structure of the barrier rib 212 illustrated in FIG. 2. For instance, the barrier rib 212 includes a first barrier rib 212*b* and a second barrier rib 212*a*. The barrier rib 212 may have a differential type barrier rib structure in which the height of the first barrier rib 212*b* and the height of the second barrier rib 212*a* are different from each other, a channel type barrier rib structure in which a channel usable as an exhaust path is formed on at least one of the first barrier rib 212*b* or the second barrier rib 212*a*, a hollow type barrier rib structure in which a hollow is formed on at least one of the first barrier rib 212*b* or the second barrier rib 212*a*, and the like.

While FIG. 2 has been illustrated and described to have the red (R), green (G), and blue (B) discharge cells arranged on the same line, it is possible to arrange the red (R), green (G), and blue (B) discharge cells in a triangle shape.

A phosphor layer 214 for emitting visible light is formed between the barrier ribs 212. The phosphor layer may include red (R), green (G), and blue (B) phosphor layers, and may further include a white (W) phosphor layer and/or a yellow (Y) phosphor layer.

The thicknesses of the red phosphor layer, the green phosphor layer and the blue phosphor layer may be substantially equal to each other. Further, at least one of red phosphor layer, the green phosphor layer and the blue phosphor layer may be different from the thicknesses of the other phosphor layers.

Although FIG. 2 illustrates a case where the upper dielectric layer 204 and the lower dielectric layer 215 each are formed in only one layer, they may be formed in a plurality of layers. A black layer (not illustrated) for absorbing external light may be further formed on the upper portion of the barrier rib 212 to prevent the reflection of the external light caused by the barrier rib 212. Further, another black layer (not illustrated) may be further formed at a specific position of the front substrate 201 corresponding to the barrier rib 212.

The third electrode 213 formed on the rear substrate 211 may have a substantially constant width or thickness. Further, the width or thickness of the third electrode 213 inside the discharge cell may be different from the width or thickness of the third electrode 213 outside the discharge cell. For instance, the width or thickness of the third electrode 213 inside the discharge cell may be more than the width or thickness of the third electrode 213 outside the discharge cell.

Figure 3:
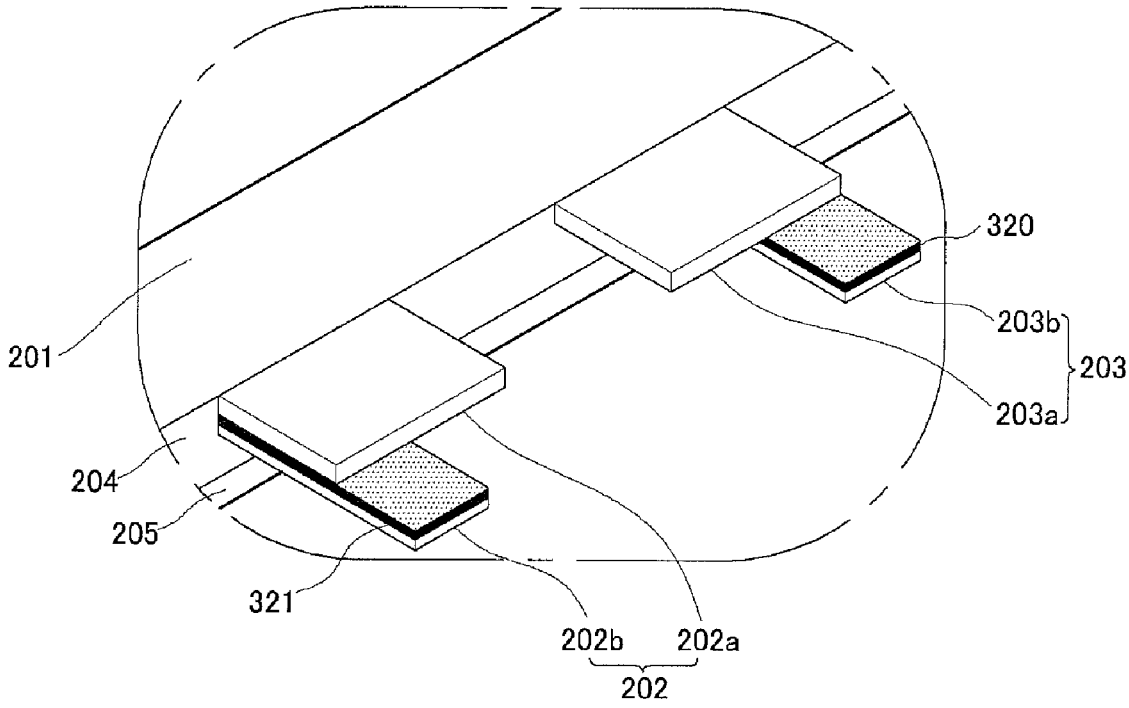
FIG. 3 is a view showing a structure of a first electrode or second electrode of FIG. 1.

As shown in FIG. 3, at least one of the first electrode 202 or the second electrode 203 may be formed in a plurality of layers. For example, at least one of the first electrode 202 and the second electrode 203 may comprise bus electrodes 202*b* and 203*b* and transparent electrodes 202*a* and 203*a*. If the first electrode 202 and the second electrode 203 comprise transparent electrodes 202*a* and 203*a*, visible light generated within the discharge cell may be effectively emitted to the outside of the plasma display panel.

As electrical conductivity of the transparent electrodes 202*a* and 203*a* is relatively low, the bus electrodes 202*b* and 203*b* can compensate for the low electrical conductivity of the transparent electrodes 202*a* and 203*a*.

Black layers 320 and 321 may be further provided between the transparent electrodes 202*a* and 203*a* and the bus electrodes 202*b* and 203*b* in order to prevent reflection of external light due to the bus electrodes 202*b* and 203*b*.

Figure 4:
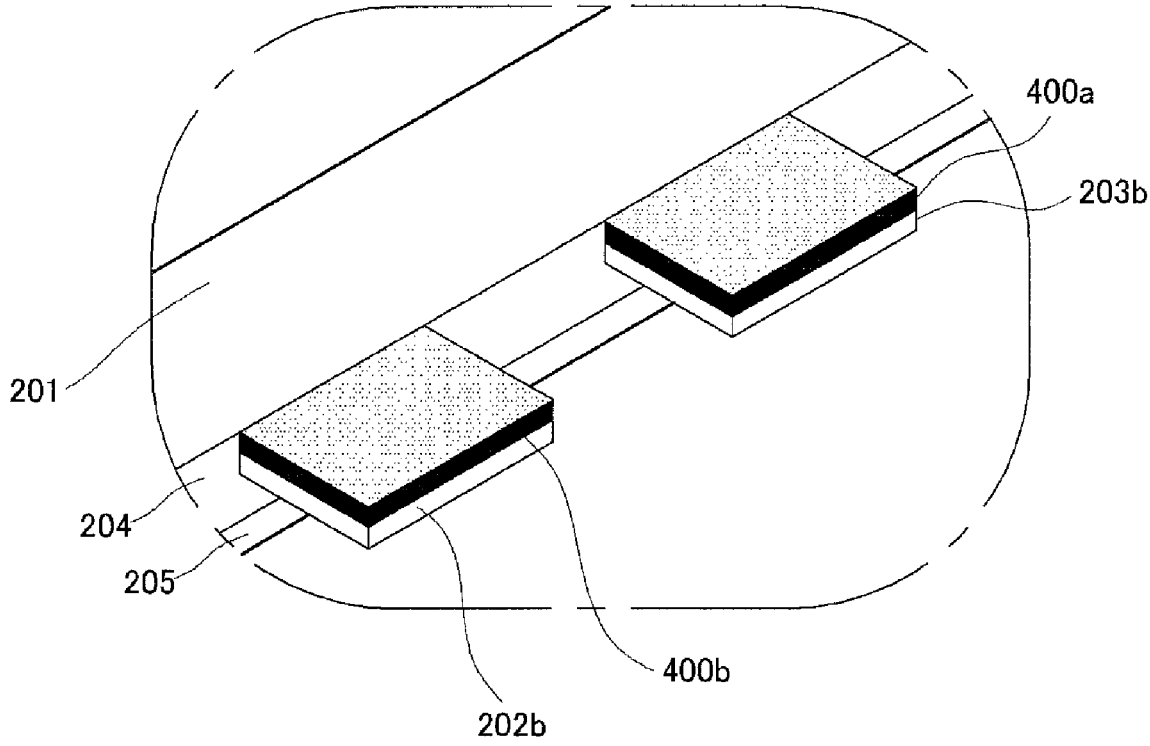
FIG. 4 is a view showing another structure of the first electrode or second electrode.

As shown in FIG. 4, the first electrode 202 and the second electrode 203 may comprise only the bus electrodes 202*b* and 203*b* since the transparent electrodes 202*a* or 203*a* are omitted in FIG. 3.

If at least one of the first electrodes 202 (Y) and the second electrode 203 (Z) is one layer, a manufacturing process of the plasma display panel becomes simpler and a manufacturing cost thereof can be reduced.

Black layers 400*a* and 400*b* that prevents discoloration of the front substrate 201 may be further provided between the first electrode 202 (Y), the second electrode 203 (Z), and the front substrate 201. The black layers 400*a* and 400*b* may have a color darker than at least one of the first electrode 202 and the second electrode 203. The black layers 400*a* and 400*b* may be made of ruthenium.

If the black layers 400*a* and 400*b* are provided between the front substrate 201, the first electrode 202 (Y), and the second electrode 203 (Z), reflection of light from the first electrode 202 (Y) and the second electrode 203 (Z) can be prevented.

Figure 5:
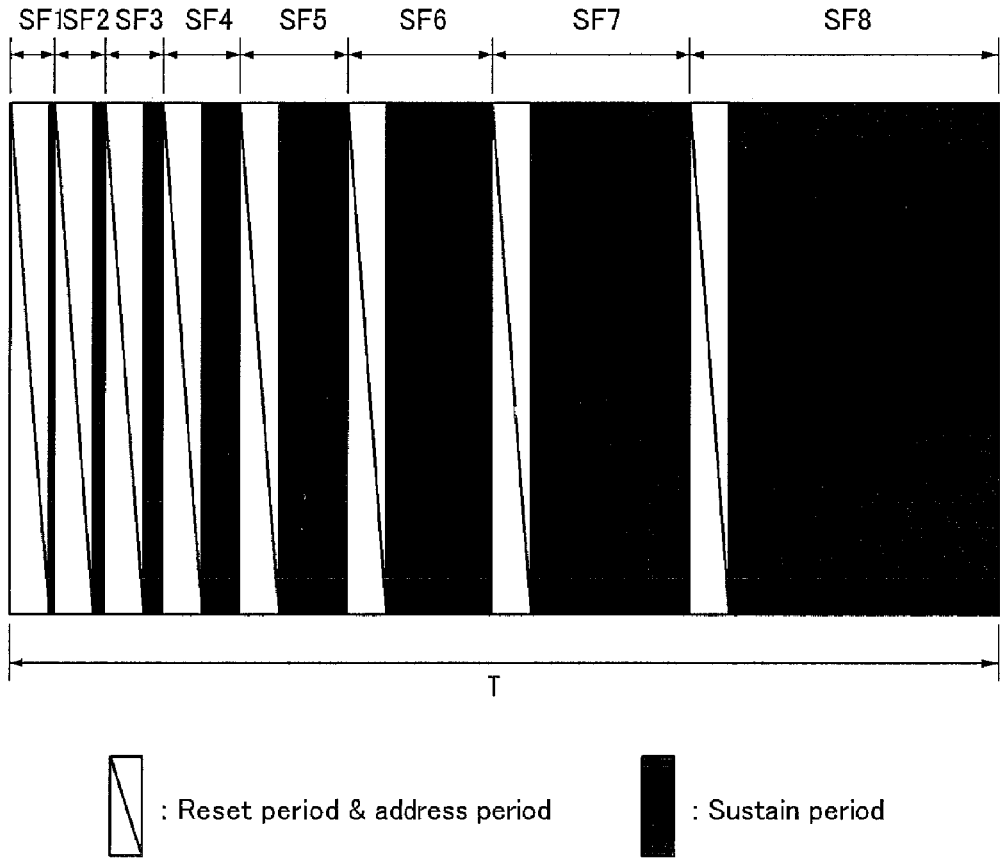
FIG. 5 is a view showing a method of implementing gray levels of an image in the plasma display panel of FIG. 1.

As shown in FIG. 5, an image frame may comprise a plurality of subfields SF1-SF8 having the different light emitting number. Each of the subfields comprises a reset period for initializing discharge cells, an address period for selecting a cell to be discharged, and a sustain period for embodying a gray level according to the discharge number.

According to the number of a sustain signal supplied in a sustain period, a gray level weight of each subfield may be set. For example, a gray level weight of each subfield may be determined so that a gray level weight of each subfield is increased in a ratio of $2^n$ (n=0, 1, 2, 3, 4, 5, 6, 7).

FIG. 5 shows only a case where one image frame comprises 8 subfields, however, one image frame may comprise more than 8 subfields. Furthermore, in FIG. 5, subfields are arranged in increasing order of a gray level weight, but subfields may be arranged in decreasing order of a gray level weight or regardless of a gray level weight.

Figure 6:
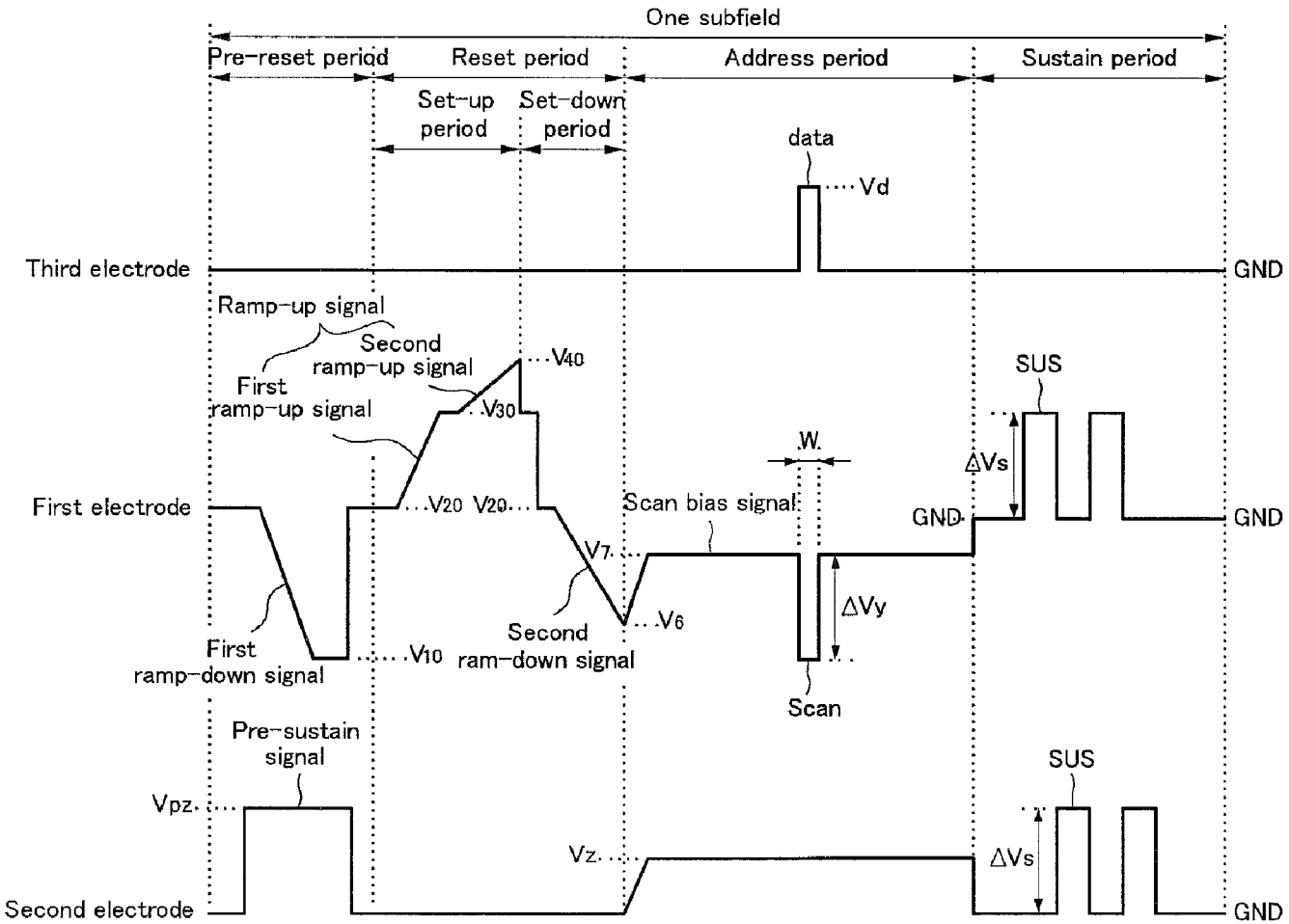
FIG. 6 is a view showing a driving signal of the plasma display apparatus according to the embodiment of the present invention.

As shown in FIG. 6, a first ramp-down signal gradually falling to a negative voltage V10 is supplied to the first electrode Y in a pre-reset period before a reset period. While the first ramp-down signal is supplied to the first electrode Y, a pre-sustain signal rising to a positive voltage Vpz is supplied to the second electrode Z. Here, the pre-sustain voltage Vpz is approximately equal to a sustain voltage Vs supplied during a sustain period.

In this way, in a pre-reset period, if the first ramp-down signal is supplied to the first electrode Y and a pre sustain signal is supplied to the second electrode Z, a predetermined polarity of wall charges are stacked on the first electrode Y and wall charges having a polarity opposite to the first electrode Y are stacked on the second electrode Z. Accordingly, in a reset period, a set-up discharge may stably occur, and thus the highest voltage of a ramp-up signal supplied to the first electrode Y may become smaller.

By comprising a pre-reset period before a reset period in a subfield arranged in the first in time among subfields of an image frame, reset periods, address periods, or sustain periods of the other subfields may be increased. Otherwise, a pre-reset period may be comprised before a reset period in two or three subfields among subfields of an image frame. A pre-reset period may be omitted in all subfields.

After a pre-reset period, in a set-up period of a reset period, a ramp-up signal is supplied to the first electrode Y. Here, a ramp-up signal may comprise a first ramp-up signal that gradually rises with a first slope from a voltage V20 to a voltage V30 and a second ramp-up signal that rises with a second slope from a voltage V30 to a voltage V40.

A weak dark discharge, i.e., a set-up discharge is generated within a discharge cell by a ramp-up signal. A second slope of the second ramp-up signal may be smoother than a first slope thereof. In this way, if the second slope is smoother than the first slope, a voltage relatively fast rises until a set-up discharge is generated and a voltage relatively slowly raises while a set-up discharge is generated, thereby reducing an amount of light generating by the set-up discharge. Accordingly, contrast characteristics can be improved.

In a set-down period after a set-up period, a second ramp-down signal is supplied to the first electrode Y. Here, the second ramp-down signal gradually falls from the voltage V20 to a voltage V6. As the second ramp-down signal is supplied, a feeble erase discharge, i.e., a set-down discharge is generated within a discharge cell. Wall charges of extent to stably generate an address discharge are uniformly sustained within the discharge cell by the set-down discharge.

In an address period after a reset period, a scan bias signal of substantially sustaining a voltage higher than the voltage V6 of the second ramp-down signal is supplied to the first electrode Y. Furthermore, a scan signal (Scan) that falls by a scan voltage ΔVy from a scan bias signal may be supplied to all of the first electrode Y.

A width of the scan signal Scan may be varied in a subfield unit. That is, a width of the scan signal Scan in at least one subfield may be different from that of a scan signal Scan in other subfields. When a scan signal Scan is supplied to the first electrode Y, a data signal rising to a data voltage Vd is supplied to the third electrode X to correspond to the scan signal. An address discharge occurs within a discharge cell in which the scan signal Scan and the data signal Data are simultaneously supplied.

In an address period, a sustain bias voltage Vz may be supplied to the second electrode Z in order to prevent that an address discharge becomes unstable by interference of the second electrode Z.

In a sustain period for displaying an image, a sustain signal SUS is supplied to at least one of the first electrode Y and the second electrode Z. For example, the sustain signal SUS may be alternately supplied to the first electrode Y and the second electrode Z.

If the sustain signal SUS is supplied, a sustain discharge occurs within the discharge cell in a discharge cell selected by an address discharge and light is emitted.

Figure 7:
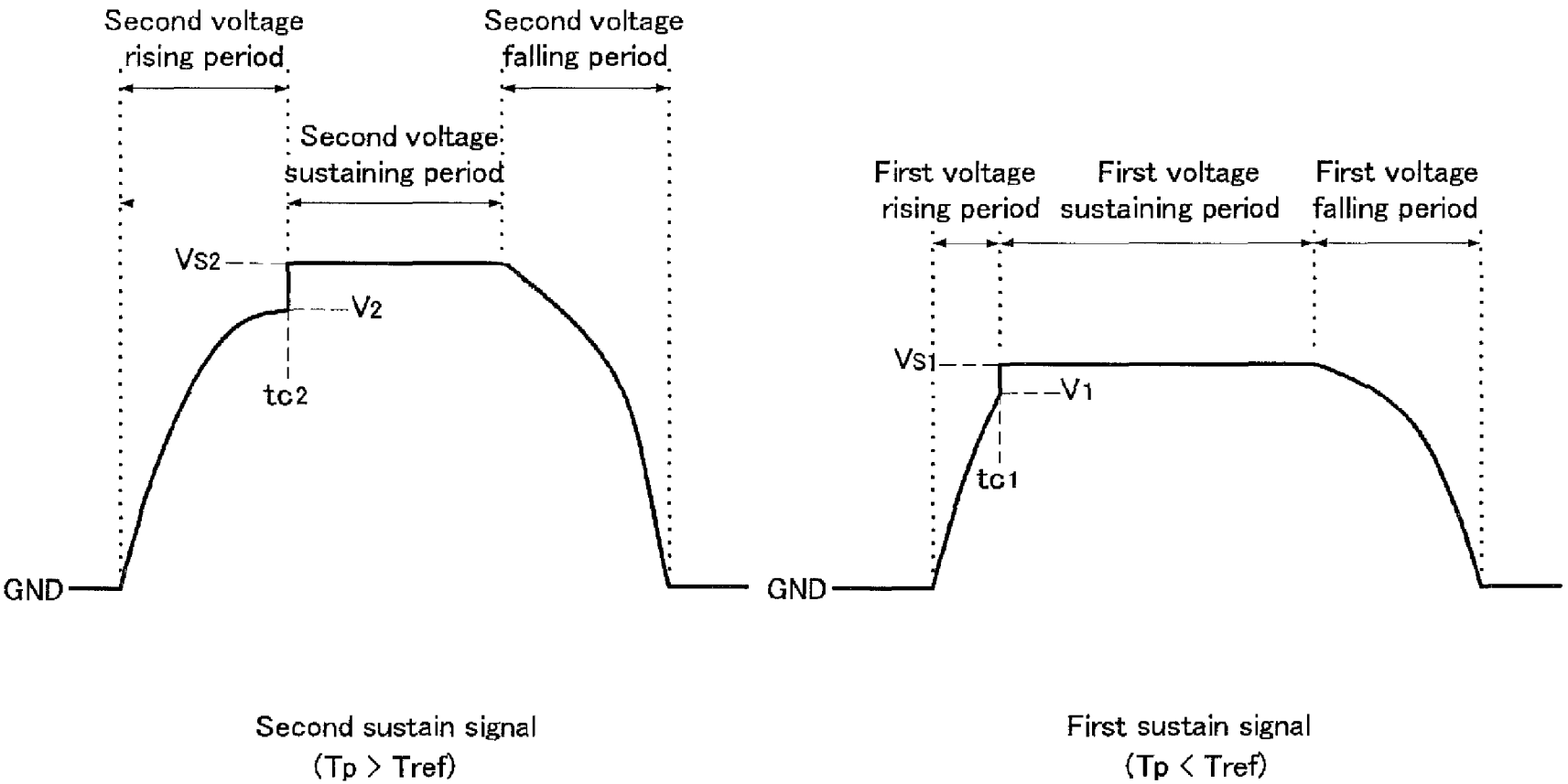
FIG. 7 is a view showing a sustain signal of FIG. 6 in detail.

As shown in FIG. 7, if the temperature Tp of the plasma display panel is lower than a reference temperature Tref in a sustain period of an image frame, the driver 120 of FIG. 1 clamps a first sustain signal, which is supplied to at least one of the first electrodes Y1-Yn and second electrodes Z1-Zn, at a first clamping time. If the temperature Tp of the plasma display panel 100 is higher than the reference temperature Tref, the driver 120 clamps a second sustain signal, which is supplied to at least one of the first electrodes and the second electrodes, at a second clamping time different from the first clamping time.

The first sustain signal may be clamped at a first voltage, and the second sustain signal may be clamped at a second voltage higher than the first voltage.

A period for supplying the first sustain signal or the second sustain signal comprises a voltage rising period, a voltage sustaining period, and a voltage falling period. The driver 120 supplies, to at least one of the first electrode and the second electrode, the first sustain signal and second sustain signal that gradually rises from a ground level voltage GND to a first voltage V1 and a second voltage V2 at a first clamping time tc1 and a second clamping time tc2. The first clamping time tc1 and the second clamping time tc2 may be a time point of finishing the voltage rising period in which a voltage of at least one of the first electrode and the second electrode gradually rises by resonance. Further, the first voltage V1 and the second voltage V2 may be the highest value of the voltage of at least one of the first electrode and the second electrode that is formed by resonance.

Here, the second voltage V2 is higher than the first voltage V1. That is, the higher the temperature Tp of the plasma display panel, the greater the voltages of the electrodes at the clamping times. The reason why the higher the temperature Tp of the plasma display panel, the greater the voltages of the electrodes at the clamping times is to compensate for the shortage of wall charges caused by a temperature rise of the plasma display panel.

In other words, wall charges and space charges are distributed within the discharge cells of the plasma display panel. The wall charges participate in a sustain discharge, and the space discharges do not participate in a sustain discharge. When the temperature of the plasma display panel increases, the wall charges and the space charges are electrically coupled and neutralized. This may cause the shortage of the amount of wall charges within the discharge cells. Accordingly, when a sustain signal is supplied, the intensity of a sustain discharge may be weaker or there may occur no sustain discharge. A voltage increase of the electrodes formed by resonance when the temperature of the plasma display panel is increased makes it possible to sufficiently obtain wall charges that may be in shortage within the discharge cells, thereby causing a stable sustain discharge.

If the temperature of the plasma display panel is lower than the reference temperature, the second voltage V2 of the second sustain signal is higher than the first voltage V1 of the first sustain signal. Therefore, the driver 120 supplies a first sustain signal having a first voltage rising period to at least one of the first electrode and the second electrode. If the temperature of the plasma display panel is higher than the reference temperature, the driver 120 supplies a second sustain signal having a second voltage rising period to at least one of the first electrode and the second electrode.

Furthermore, the driver 120 of FIG. 1 receives a temperature information signal from the temperature detector 110, and, if the temperature Tp of the plasma display panel is lower than a reference temperature Tref, the driver 120 may supply a first sustain voltage Vs1 higher than the first voltage V1 to at least one of the first electrodes and second electrodes. Otherwise, if the temperature Tp of the plasma display panel is higher than the reference temperature Tref, the driver 120 may supply a second sustain voltage Vs2 higher than the first sustain voltage Vs1 to at least one of the first electrode and the second electrode.

The first sustain voltage Vs1 and the second sustain voltage Vs2 are supplied to at least one of the first electrode and the second electrode during a voltage sustaining period of the first sustain signal and the second sustain signal. That is, the higher the temperature Tp of the plasma display panel, the greater the sustain voltage.

The reason why the higher the temperature Tp of the plasma display panel, the greater the sustain voltage is to compensate for the shortage of wall charges caused by a temperature rise of the plasma display panel. An increase of the sustain voltage caused by a temperature rise of the plasma display panel makes it possible to sufficiently obtain wall charges that may be in shortage within the discharge cells, thereby causing a stable sustain discharge.

Figure 8:
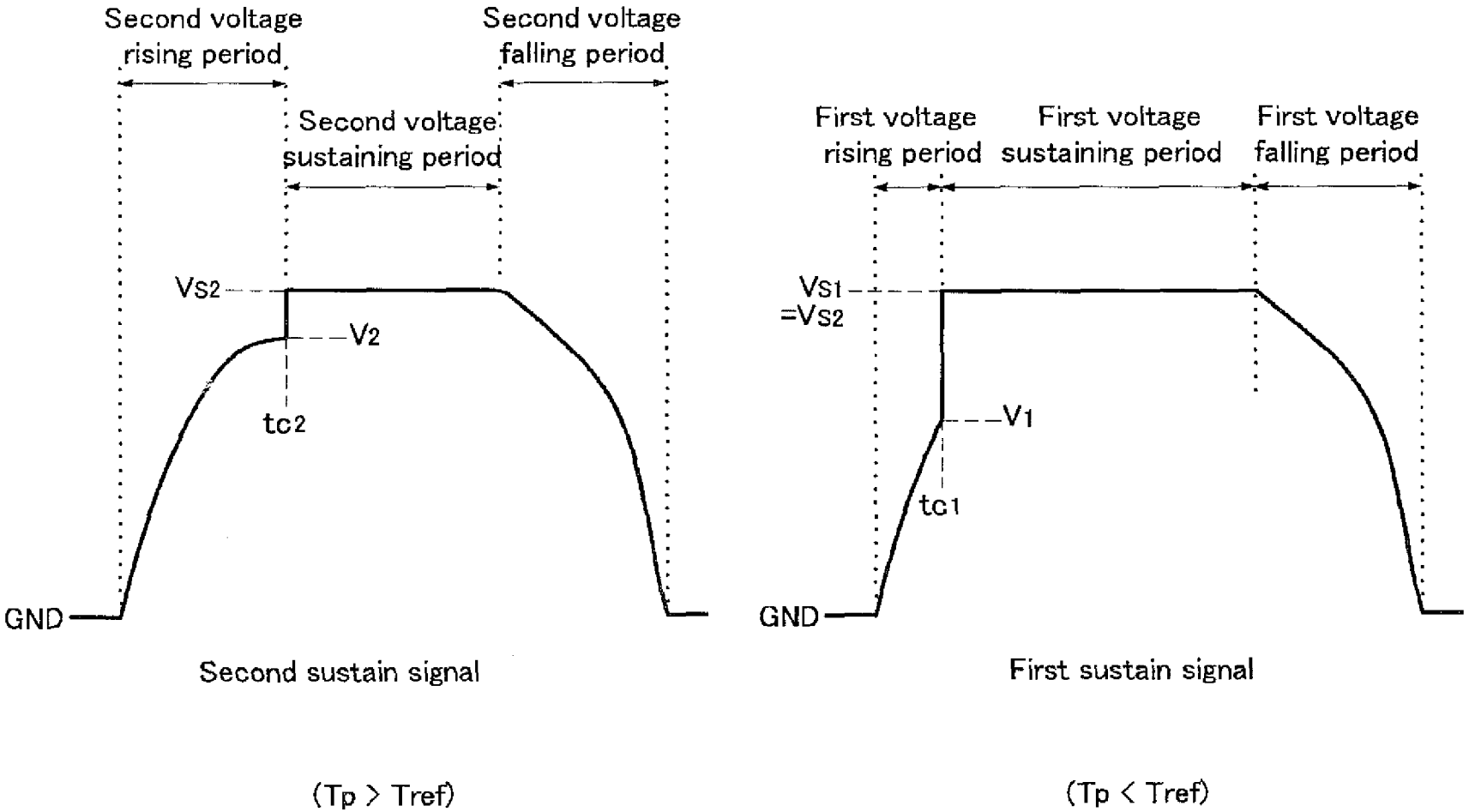
FIG. 8 is a view showing another embodiment of the sustain signal of FIG. 6.

Although FIG. 7 illustrates a case where the higher the temperature of the plasma display panel, the greater the sustain voltage, the first sustain voltage Vs1 and the second sustain voltage Vs2 may be substantially equal to each other as shown in FIG. 8. That is, the driver 120 may supply the first sustain voltage Vs1 higher than the first voltage V1 to at least one of the first electrode and the second electrode, and may supply the second sustain voltage Vs2 substantially equal to the first sustain voltage Vs1 to at least one of the first electrode and the second electrode.

Figure 9:
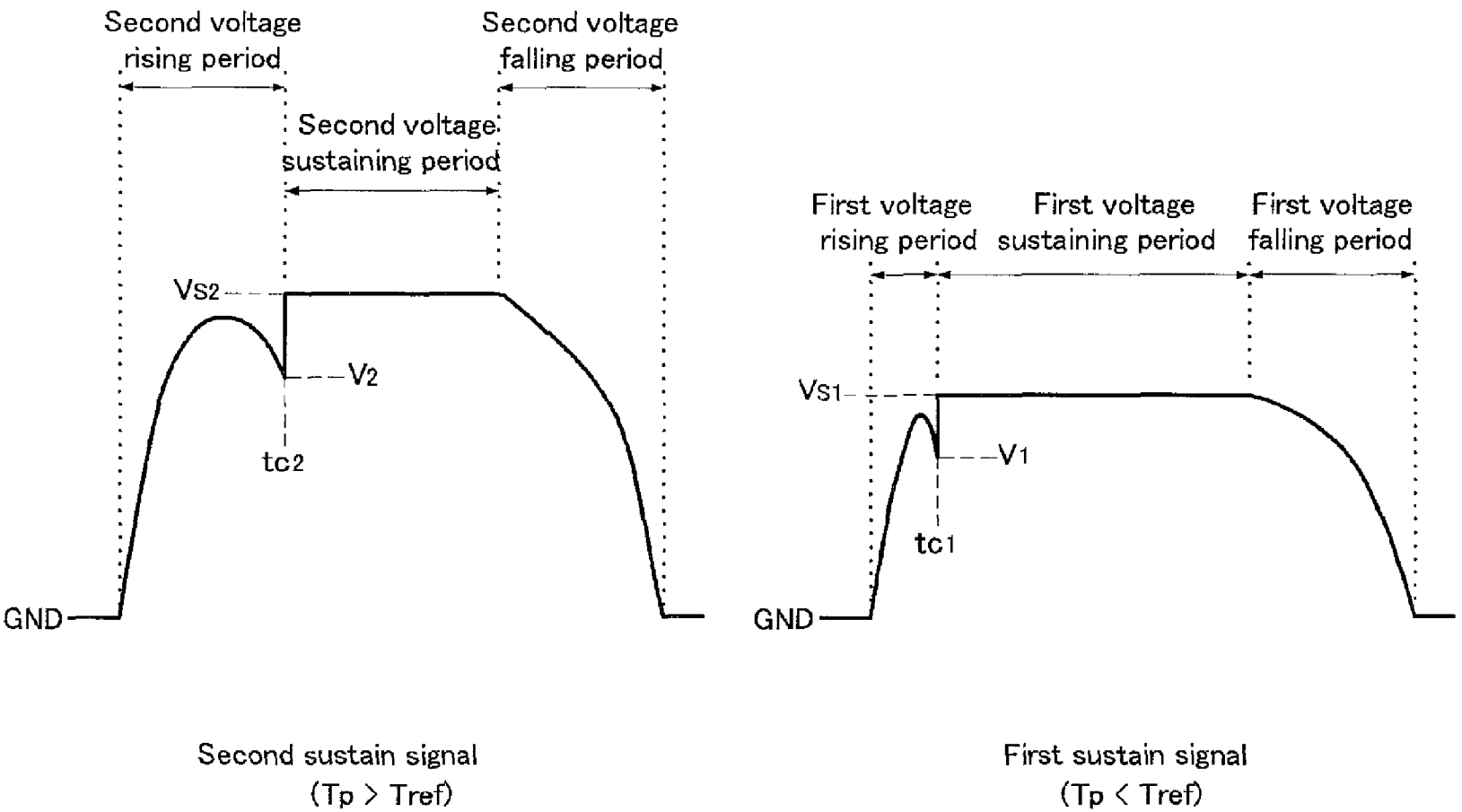
FIG. 9 is a view showing still another embodiment of the sustain signal of FIG. 6.

During a first voltage rising period and a second voltage rising period, the voltages of the electrodes are formed by resonance. Accordingly, as shown in FIG. 9, if the first voltage rising period and the second voltage rising period are increased, the voltages of the electrodes gradually rise and then gradually fall. If the temperature Tp of the plasma display panel is lower than the reference temperature Tref, the first sustain signal gradually rises and then gradually falls to the first voltage V1. Further, if the temperature Tp of the plasma display panel is higher than the reference temperature Tref, the second sustain signal gradually rises and then gradually falls to the second voltage V2. Here, the first voltage V1 and the second voltage V2 are electrode voltages at the first clamping time tc1 and the second clamping time tc2. Therefore, a reduction of wall charges caused by a temperature rise of the plasma display panel may be compensated for.

Figure 14:
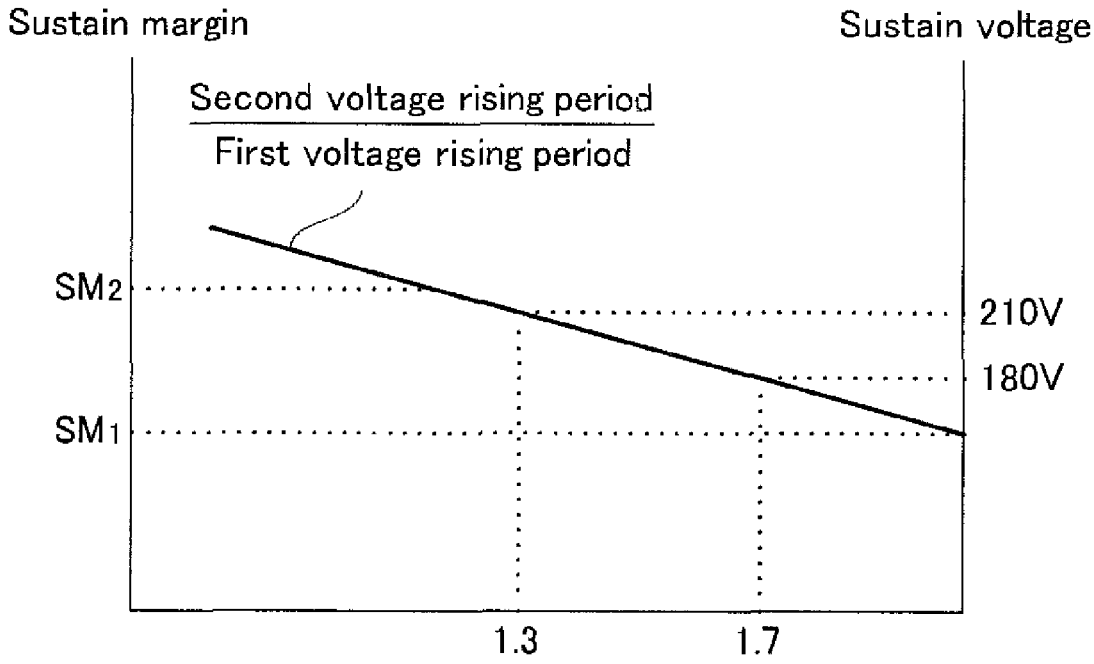
FIG. 14 is a graph showing the relationship among the ratio of a second voltage rising period to a first voltage rising time, a sustain margin, and a sustain voltage.

In FIGS. 7 to 9, if the ratio of the second voltage rising period with respect to the first voltage rising period is greater than 1.3 and less than 1.7, a sustain margin can be secured while compensating for a reduction of wall charges caused by the temperature rise of the plasma display panel. If a sufficient sustain margin is between SM1 and SM2, as shown in FIG. 14, it can be known that when the ratio of the second voltage rising period with respect to the first voltage rising period is greater than 1.3 and less than 1.7, the sustain voltage is greater than 180V and less than 210V. That is, a stable sustain discharge may occur when the sustain voltage is greater than 180V and less than 210V, and thus when the ratio of the second voltage rising period with respect to the first voltage rising period is greater than 1.3 and less than 1.7, a sustain margin can be secured and a stable sustain discharge can occur.

Figure 10:
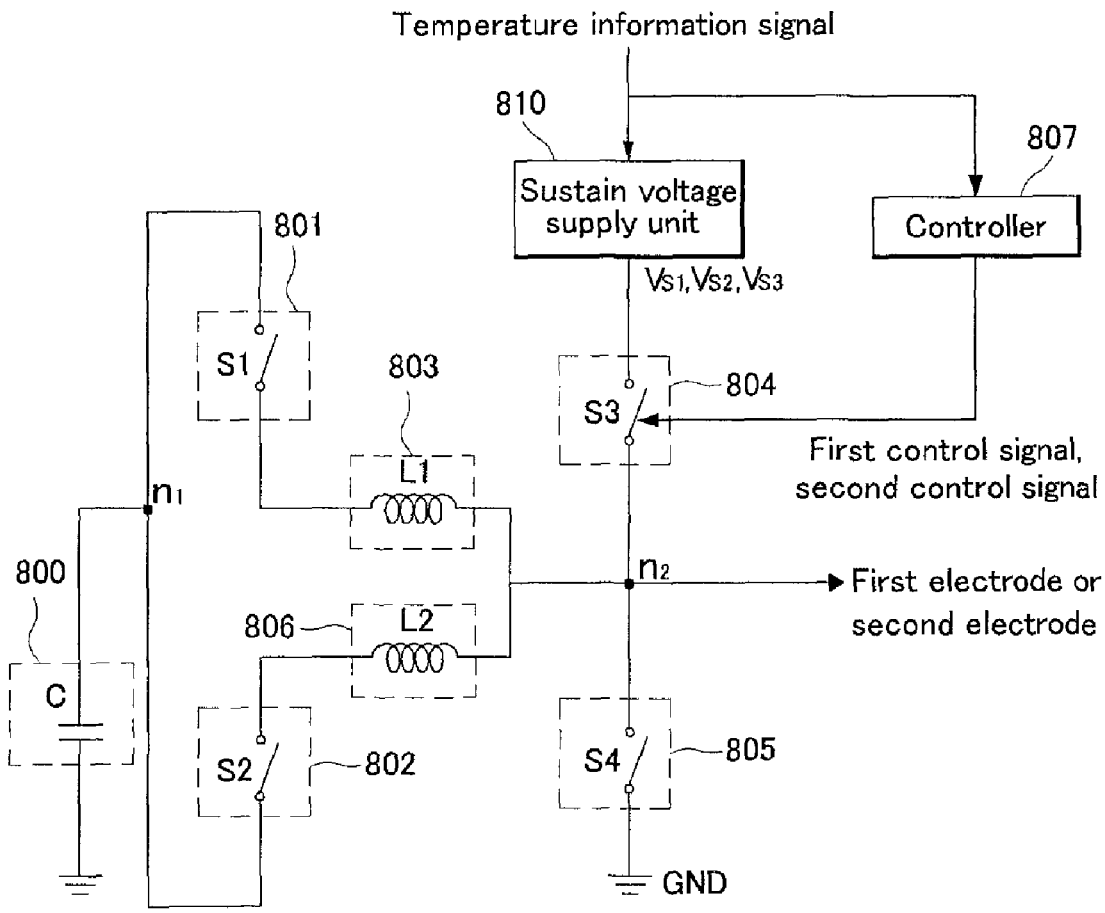
FIG. 10 is a view showing a driver of FIG. 1.

As shown in FIG. 10, the driver 120 of FIG. 1 comprises an energy storing unit 800, an energy supply unit 801, an energy recovery unit 802, a first voltage supply unit 804, a second voltage supply unit 805, a first inductor unit 803, a second inductor unit 806, a controller 807, and a sustain voltage supply unit 810.

The energy storing unit 800 stores the energy that is supplied to the first electrode or the second electrode, or recovered from the first electrode or the second electrode. In order to store the energy, the energy storing unit 800 comprises a capacitor C.

The energy supply unit 801 supplies the voltage of the energy supply unit 800 to the first electrode or the second electrode. That is, the energy supply unit 801 supplies the energy corresponding to the voltage of the energy storing unit 800 to the first electrode or the second electrode. The energy supply unit 801 comprises a first switch S1. When the first switch S1 is turned on, the voltage of the energy supplying unit 800 is supplied to the first electrode or second electrode of the plasma display panel.

The energy recovery unit 802 recovers the energy from the first electrode or the second electrode to the energy storing unit 801. The energy recovery unit 802 comprises a second switch S2. When the second switch S2 is turned on, the energy is recovered from the first electrode or second electrode of the plasma display panel to the energy storing unit 800.

The first inductor unit 803 forms resonance with the plasma display panel when the energy supply unit 801 supplies the energy of the energy storing unit 800. That is, when the first switch S1 of the energy supply unit 801 is turned on, a first inductor L1 and the first electrode or second electrode of the plasma display panel are electrically connected, and the voltage of the energy storing unit 800 is supplied to the first electrode or the second electrode.

The second inductor unit 806 forms resonance when the energy recovery unit 802 recovers the energy from the first electrode or the second electrode to the energy storing unit. That is, when the second switch S2 of the energy recovery unit 802 is turned on, a second inductor L2 and the first electrode or second electrode of the plasma display panel are electrically connected, and the energy is recovered from first electrode or the second electrode to the energy storing unit 800.

The controller 807 outputs a first control signal if the temperature of the plasma display panel corresponding to the temperature information signal received from the temperature detector 110 is lower than the reference temperature, and outputs a second control signal if the temperature of the plasma display panel is higher than the reference temperature.

The sustain voltage supply unit 810 supplies a first sustain voltage if the temperature of the plasma display panel corresponding to the temperature information signal received from the temperature detector 110 is lower than the reference temperature, and supplies a second sustain voltage higher than the first sustain voltage if the temperature of the plasma display panel is higher than the reference temperature.

The first voltage supply unit 804 is turned on at the first clamping time tc1 of FIGS. 7 to 9 upon receipt of the first control signal from the controller 807, and is turned on at the second clamping time tc2 of FIGS. 7 to 9 upon receipt of the second control signal. When the first voltage supply unit 804 is turned on, the voltage sustaining period of the first sustain signal and the second sustain signal. The first voltage supply unit 804 comprises a third switch S3. The third switch S3 is turned on by the first control signal and the second control signal.

Further, the first voltage supply unit 804 can supply the first sustain voltage or the second sustain voltage to the first electrode or the second electrode. That is, the sustain voltage supply unit 810 supplies a first sustain voltage or a second sustain voltage according to the temperature of the plasma display panel. Accordingly, when the first voltage supply unit 804 is turned on, the first sustain voltage or the second sustain voltage is supplied to the electrodes.

The second sustain voltage 805 supplies a ground voltage GND to the first electrode or the second electrode. The second sustain voltage 805 comprises a fourth switch S4. When the fourth switch S4 is turned on, the ground voltage is supplied to the first electrode or the second electrode.

Figure 11:
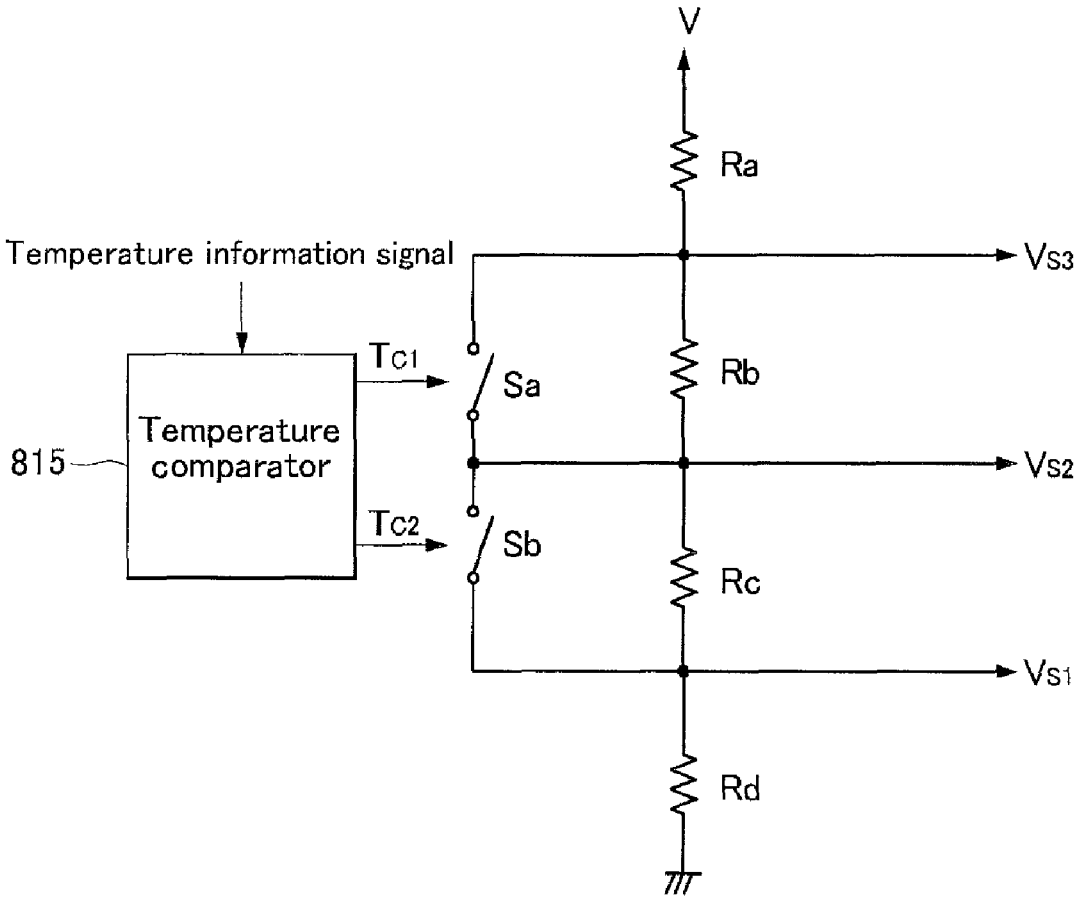
FIG. 11 is a view showing one embodiment of a sustain voltage supply unit of FIG. 10.

FIG. 11 shows the sustain voltage supply unit of FIG. 10. As shown in FIG. 11, the sustain voltage supply unit 810 of FIG. 10 may comprise a temperature comparator 815, a first voltage control switch Sa, a second voltage control switch Sb, and first to fourth voltage distribution resistors Ra, Rb, Rc, and Rd.

The temperature comparator 815 compares the temperature of the plasma display panel corresponding to the received temperature information signal with the reference temperature, and if the temperature of the plasma display panel is higher than the reference temperature, outputs a corresponding switching control signal. Here, the reference temperature may be more than one temperature. That is, if the reference temperatures are Ta and Tb (Tb>Ta), the temperature comparator 815 can compare the temperature of the plasma display panel with the reference temperatures Ta and Tb.

If the temperature of the plasma display panel is lower than Ta, switching control signals Tc1 and Tc2 for turning on the first and second voltage control switches Sa and Sb are outputted. Once the first and second control switches Sa and Sb are turned on, the voltage Vs1 applied to the fourth voltage distribution resistor Rd becomes Rd/(Ra+Rd)×V.

If the temperature of the plasma display panel is higher than Ta and lower than Tb, switching control signals Tc1 and Tc2 for turning on the first voltage control switch Sa and turning off the second voltage control switch Sb are outputted. Once the first voltage control switch Sb is turned on and the second voltage control switch Sb is turned off, the voltage Vs2 applied to the third voltage distribution resistor Rc and the fourth voltage distribution resistor Rd becomes (Rd+Rc)/(Ra+Rc+Rd)×V, and the voltage Vs2 is larger than the voltage Vs1.

If the temperature of the plasma display panel is higher than Tb, switching control signals Tc1 and Tc2 for turning off the first and second voltage control switches Sa and Sb are outputted. Once the first and second voltage control switches Sa and Sb are turned on, the voltage Vs3 applied to the second to fourth voltage distribution resistors Rb, Rc, and Rd becomes (Rb+Rc+Rd)/(Ra+Rb+Rc+Rd)×V, and the voltage Vs3 is larger than the voltage Vs2.

That is, as the temperature of the plasma display panel is increased, the sustain voltage supply unit 810 increases the sustain voltage.

In addition to the sustain voltage supply unit 810 of FIG. 11, a DC/DC converter is applicable.

Figure 12:
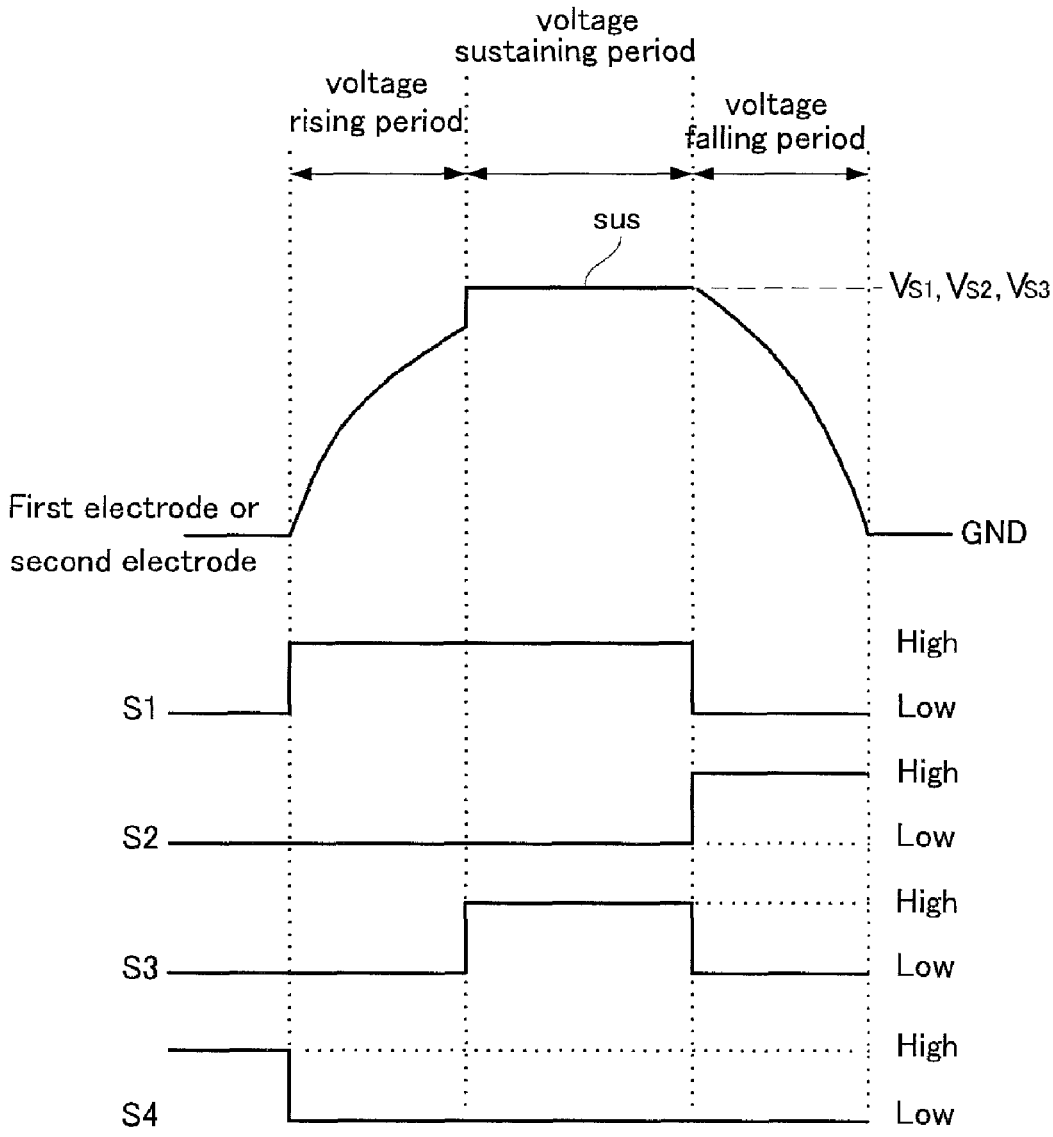
FIG. 12 is a switching timing diagram of the driver of FIG. 10.

The operation of the driver will be described in detail with reference to FIGS. 10 and 12.

In a voltage rising period, the first switch S1 is turned on, and the second to fourth switches S4 are turned off. Hence, the energy of the energy storing unit 800 is supplied to the first electrode or the second electrode via a first node n1, the second switch S1, the first inductor unit 803, and a second node n2. Accordingly, LC resonance is formed by the first inductor L1, and the voltage of the first electrode or second electrode gradually rises from the ground voltage GND.

In a voltage sustaining period, the first switch S1 and the third switch S3 are turned on, and the second switch S2 and the fourth switch S4 are turned off. Thus, the sustain voltage outputted from the sustain voltage supply unit 810 is supplied to the first electrode or the second electrode. Here, the sustain voltage is one of the first to third sustain voltages Vs1-Vs3. Therefore, the voltage of the first electrode or second electrode is kept constant as one of the first to third voltages Vs1, Vs2, and Vs3

In a voltage falling period, the second switch S2 is turned on, and the first switch S1, third switch S3, and fourth switch S4 are turned on. Hence, the energy is recovered to the energy storing unit from the first electrode or second electrode. Further, as the second inductor unit 806 forms LC resonance, the voltage of the first electrode or second electrode gradually falls to the ground voltage GND.

In a period except for the voltage rising period, the voltage sustaining period, and voltage falling period, when the fourth switch S4 is turned on, and the first to third switches S1-S3 are turned off, the ground voltage GND is supplied to the first electrode or the second electrode.

As for the first and second sustain signals of FIG. 7, the voltages V1 and V2 of the first and second electrodes are different from each other until the first clamping time tc1 and the second clamping time tc2. On the other hand, as for the first and second sustain signals of FIG. 13, the voltages V1 and V2 of the first and second electrodes that rise before the voltage sustaining period may be equal to each other.

Figure 13:
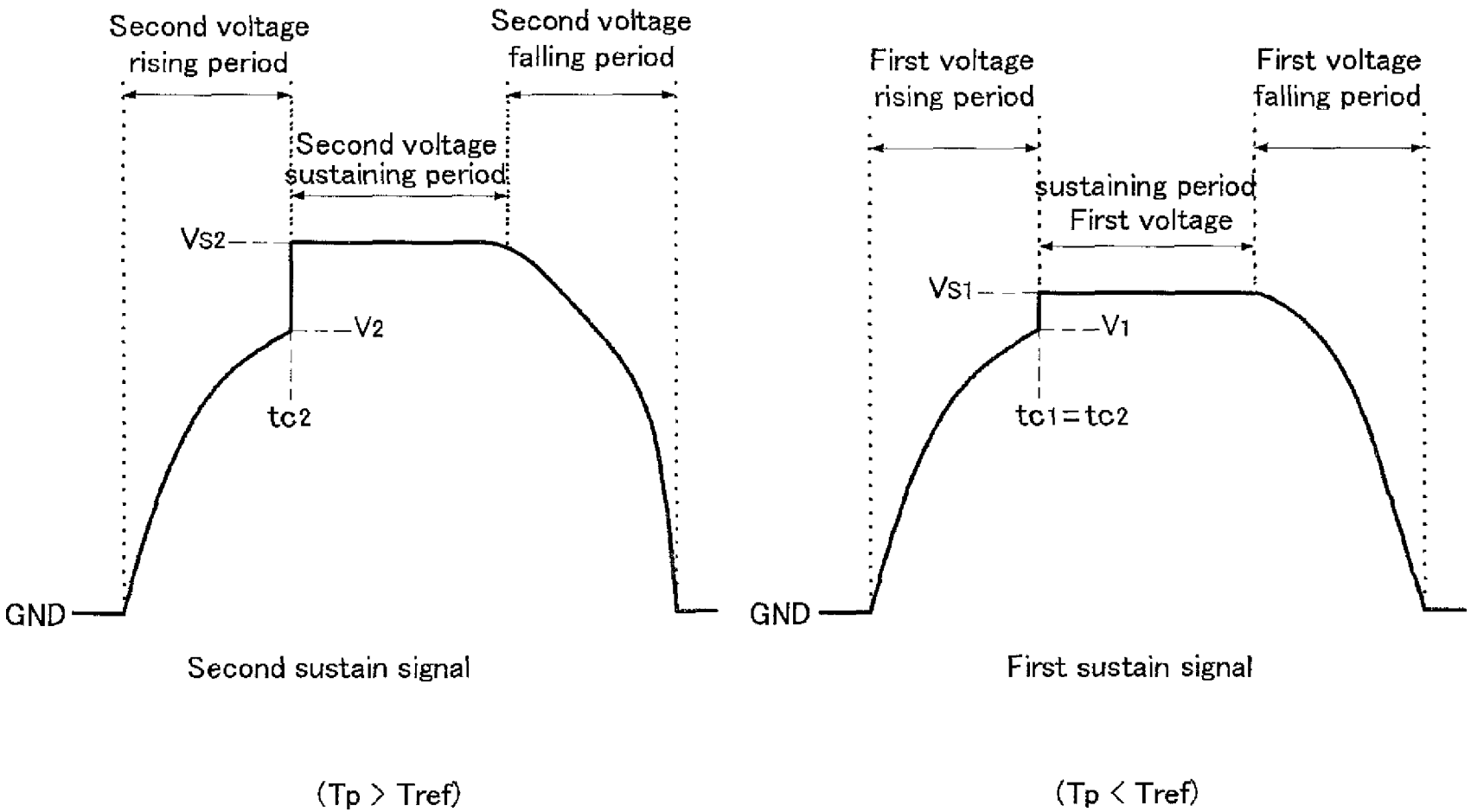
FIG. 13 is a view for explaining one example of another method for supplying a sustain signal with respect to the temperature of a plasma display panel.

If the turn-on period of the first switch S1 of FIGS. 7 and 13 becomes longer, the voltage rising period becomes longer, too. Thus, if the voltage rising period of the second sustain signal of FIG. 7 is longer than the voltage rising period of the first sustain signal of FIG. 7, the voltages of the first or second electrode that gradually rises before the voltage sustaining period are longer, too. Further, if the voltage rising period of the second sustain signal of FIG. 12 is equal to the voltage rising period of the first sustain signal of FIG. 7, the voltages of the first or second electrode that gradually rises before the voltage sustaining period are equal to each other.

As for the first sustain signal and second sustain signal of FIG. 7, when the temperature Tp of the plasma display panel is higher than the reference temperature Tref, Vs2 is greater than Vs1 and V2 is greater than V1, thereby easily compensating for a reduction of wall charges caused by a increase of the temperature Tp of the panel.

Furthermore, as in the first and second sustain signals of FIG. 13, if the voltages V1 of the first or second electrode that rise before the voltage sustaining period are equal to each other, it is easy to control the timing of the first switch S1 of FIG. 10.

The foregoing embodiments and advantages are merely exemplary and are not to be construed as limiting the present invention. The present teaching may be readily applied to other types of apparatuses. The description of the present invention is intended to be illustrative, and not to limit the scope of the claims. Many alternatives, modifications, and variations will be apparent to those skilled in the art. In the claims, means-plus-function clauses are intended to cover the structure described herein as performing the recited function and not only structural equivalents but also equivalent structures. Moreover, unless the term "means" is explicitly recited in a limitation of the claims, such limitation is not intended to be interpreted under 35 USC 112(6).

What is claimed is:

1. A plasma display apparatus, comprising:

a plasma display panel comprising a plurality of first electrodes and a plurality of second electrodes formed in parallel to each other;

a temperature detector for detecting a temperature of the plasma display panel to output a temperature information signal; and a driver which receives the temperature information signal from the temperature detector, and if the temperature of the plasma display panel is lower than a reference temperature, clamps a first sustain signal, which is supplied to at least one of the first electrodes or the second electrodes, at a first clamping time, and if the temperature of the plasma display panel is higher than the reference temperature, clamps a second sustain signal, which is supplied to at least one of the first electrodes or the second electrodes, at a second clamping time different from the first clamping time, wherein the first sustain signal is clamped at a first voltage and the second sustain signal is clamped at a second voltage higher than the first voltage.

2. The plasma display apparatus of claim 1, wherein the driver receives the temperature information signal from the temperature detector, and if the temperature of the plasma display panel is lower than a reference temperature, supplies a first sustain voltage higher than the first voltage to at least one of the first electrodes or the second electrodes, and if the temperature of the plasma display panel is higher than the reference temperature, supplies a second sustain voltage higher than the first sustain voltage to at least one of the first electrodes or the second electrodes.

3. The plasma display apparatus of claim 2, wherein the driver comprises:

an energy storing unit for storing the energy that is supplied to the first electrode or the second electrode or recovered from the first electrode or the second electrode;

an energy supply unit for supplying the voltage of the energy storing unit to the first electrode or the second electrode;

an energy recovery unit for recovering the energy from the first electrode or the second electrode to the energy storing unit;

a first inductor unit for forming resonance when supplying the energy;

a second inductor unit for forming resonance when recovering the energy;

a sustain voltage supply unit for receiving the temperature information signal and supplying the first sustain voltage if the temperature of the plasma display panel is lower than the reference temperature, and supplying the second sustain voltage if the temperature of the plasma display panel is higher than the reference temperature;

a first voltage supply unit for supplying the first sustain voltage or the second sustain voltage to the first electrode or the second electrode; and a second voltage supply unit for supplying a ground voltage to the first electrode or the second electrode.

4. The plasma display apparatus of claim 3, wherein the sustain voltage supply unit comprises:

a temperature comparator which compares the temperature of the plasma display panel corresponding to the received temperature information signal with the reference temperature, and if the temperature of the plasma display panel is higher than the reference temperature, outputs a corresponding switching control signal;

a voltage control switch to be switched according to the switching control signal; and a plurality of voltage distribution resistors which forms the second sustain voltage as the voltage control switch is switched.

5. The plasma display apparatus of claim 4, wherein the temperature comparator compares the received temperature information signal with another reference temperature and outputs a different switching control signal based on the comparison with the other reference temperature.

6. The plasma display apparatus of claim 1, wherein the driver supplies a first sustain voltage higher than the first voltage to at least one of the first electrodes or the second electrodes, and supplies a second sustain voltage substantially equal to the first sustain voltage to at least one of the first electrodes or the second electrodes.

7. The plasma display apparatus of claim 1, wherein the driver comprises:

an energy storing unit for storing the energy that is supplied to the first electrode or the second electrode or recovered from the first electrode or the second electrode;

an energy supply unit supplying the voltage of the energy storing unit to the first electrode or the second electrode;

an energy recovery unit recovering the energy from the first electrode or the second electrode to the energy storing unit;

a first inductor unit forming resonance when the energy supply unit supplies the energy of the energy storing unit;

a second inductor unit forming resonance when the energy recovery unit recovers the energy from the energy storing unit;

a controller outputting a first control signal if the temperature of the plasma display panel corresponding to the temperature information signal received from the temperature detector is lower than the reference temperature, and outputting a second control signal if the temperature of the plasma display panel is higher than the reference temperature;

a first voltage supply unit to be turned on at a first clamping time upon receipt of the first control signal, and turned on at a second clamping time upon receipt of the second control signal; and a second voltage supply unit for supplying a ground voltage to the first electrode or the second electrode.

8. A plasma display, comprising:

a plasma display panel comprising a plurality of first electrodes and a plurality of second electrodes formed in parallel to each other;

a temperature detector for detecting a temperature of the plasma display panel to output a temperature information signal; and a driver which receives the temperature information signal from the temperature detector, and if the temperature of the plasma display panel is lower than a reference temperature, clamps a first sustain signal, which is supplied to at least one of the first electrodes or the second electrodes, at a first clamping time, and if the temperature of the plasma display panel is higher than the reference temperature, clamps a second sustain signal, which is supplied to at least one of the first electrodes or the second electrodes, at a second clamping time different from the first clamping time, wherein the ratio of the voltage rising period of the first sustain signal with respect to the voltage rising period of the second sustain signal is greater than 1.3 and less than 1.7.

9. A method for driving a plasma display apparatus comprising first electrodes and second electrodes formed in parallel to each other, comprising:

if a temperature of the plasma display panel is lower than a reference temperature, clamping a first sustain signal, which is supplied to at least one of the first electrodes or the second electrodes, at a first clamping time; and if the temperature of the plasma display panel is higher than the reference temperature, clamping a second sustain signal, which is supplied to at least one of the first electrodes or the second electrodes, at a second clamping time different from the first clamping time, wherein the first sustain signal is clamped at a first voltage and the second sustain signal is clamped at a second voltage higher than the first voltage.

10. The method of claim 9, further comprising:

if the temperature of the plasma display panel is lower than a reference temperature, supplying a first sustain voltage higher than the first voltage to at least one of the first electrodes or the second electrodes; and if the temperature of the plasma display panel is higher than the reference temperature, supplying a second sustain voltage higher than the first sustain voltage to at least one of the first electrodes or the second electrodes.

11. The method of claim 9, further comprising:

supplying a first sustain voltage higher than the first voltage to at least one of the first electrodes or the second electrodes; and supplying a second sustain voltage substantially equal to the first sustain voltage to at least one of the first electrodes or the second electrodes.

12. The method of claim 9, further comprising:

comparing the temperature of the plasma display panel to another reference temperature; and changing at least one of the first sustain signal or the second sustain signal based on the comparison of the other reference temperature.

13. A method for driving a plasma display apparatus comprising first electrodes and second electrodes formed in parallel to each other, comprising:

if a temperature of the plasma display panel is lower than a reference temperature, supplying a first sustain signal having a first voltage rising period to at least one of the first electrodes or the second electrodes; and if the temperature of the plasma display panel is higher than the reference temperature, supplying a second sustain signal having a second voltage rising period longer than the first voltage rising period to at least one of the first electrodes or the second electrodes, wherein the ratio of the voltage rising period of the first sustain signal with respect to the voltage rising period of the second sustain signal is greater than 1.3 and less than 1.7.

14. The method of claim 13, wherein the voltage of the first electrode or second electrode at a second clamping time when the second voltage rising period is finished is higher than the voltage of the first electrode or second electrode at a first clamping time when the first voltage rising period is finished.

15. The method of claim 13, further comprising:

if the temperature of the plasma display panel is lower than a reference temperature, supplying a first sustain voltage to at least one of the first electrodes or the second electrodes after a first clamping time; and if the temperature of the plasma display panel is higher than the reference temperature, supplying a second sustain voltage substantially equal to the first sustain voltage to at least one of the first electrodes or the second electrodes after a second clamping time.

16. A method for driving a plasma display apparatus comprising first electrodes and second electrodes formed in parallel to each other, comprising:

if a temperature of the plasma display panel is lower than a reference temperature, supplying a first sustain voltage to at least one of the first electrodes or the second electrodes after a first clamping time; and if the temperature of the plasma display panel is higher than the reference temperature, supplying a second sustain voltage higher than the first sustain voltage to at least one of the first electrodes or the second electrodes after a second clamping time.

* * * * *